United States Patent [19]

Bengtson

[11] Patent Number: 4,562,647

[45] Date of Patent: Jan. 7, 1986

[54] ALIGNMENT JIG FOR ATTACHING NOCKS ON ARCHERY ARROWS

[76] Inventor: Björn Bengtson, Fagerangsvagen 34, S-141 37, Huddinge, Sweden

[21] Appl. No.: 592,022

[22] Filed: Mar. 22, 1984

[51] Int. Cl.[4] ..... G01B 5/25

[52] U.S. Cl. ..... 33/286; 33/180 R

[58] Field of Search ..... 33/180 R, 181 R, 286; 269/38; 273/106.5; 350/110, 114, 116; 356/242, 399, 401, 397, 153

[56] References Cited

U.S. PATENT DOCUMENTS

| | | | |
|---|---|---|---|
| 3,121,280 | 2/1964 | McFadden | 269/38 X |
| 3,338,772 | 8/1967 | McWherter | 269/38 X |
| 3,859,728 | 1/1975 | Shutt | 33/180 R |

*Primary Examiner*—Harry N. Haroian

*Attorney, Agent, or Firm*—Wigman & Cohen

[57] ABSTRACT

An alignment jig for use in attaching nocks on archery arrows is disclosed. The invention comprises a rigid base plate having a first support for the rear end of the arrow, at which the nock is to be mounted, and at least one additional arrow support spaced apart from and longitudinally aligned with the first support. A first reference line is arranged on the base plate and extends in a plane through the supports and at right angles to the plate, the first reference line being disposed at the opposite side of the first support relative the additional support or supports. A second reference line also extends in the plane and is parallel with the first reference line but is disposed on the opposite side of an arrow supported by the supports relative to the first reference line. A sight device, for aligning the pair of reference lines through the nock groove, is included, whereby the attainment of a proper longitudinal alignment of the nock with the end of the arrow can be checked with good accuracy.

19 Claims, 2 Drawing Figures

ALIGNMENT JIG FOR ATTACHING NOCKS ON ARCHERY ARROWS

BACKGROUND OF THE INVENTION

The present invention relates to an alignment jig for use in attaching nocks on archery arrows.

Archery arrows presently manufactured are made as metals tubes forming the arrow shaft. At the front end, the shaft end is provided with a point while guide fins are attached adjacent the rear end. The rear end of the shaft is made in a conical shape. Mounted thereon, usually by cementing, is a so called nock provided with a groove for the bow string. The nock is made of plastic and may be damaged or destroyed during repeated use of the arrow. This breakage occurs usually by hitting other arrows at the target. Damaged nocks have to be replaced, which has turned out to be a difficult job, particularly during outdoor competitions.

It is of great important, particularly in competition target archery, that the nock be properly aligned with the shaft. Mis-alignment by as little as a few thousandths of an inch may cause the point of impact on the target to be affected by as much as six inches at 40 yards. When replacing damaged nocks with new ones, the archer must remove fragments of the old nock and cement from the shaft end, apply a small quantity of suitable cement to said end and then press the new nock onto the shaft and taper before the cement has dried. The nock is first rotated until the nock groove is aligned at a right angle to the upper fin (referred to by archers as the "cook fin") and the nock is then checked for straightness before the cement has set. This process can be carried out in two ways.

Firstly, the arrow can be rolled on a flat smooth surface and visually watched for any wobble. Alternatively, the arrow can be spun by resting the shaft on the finger nails of the thumb and middle finger (with the point against palm of other hand) and blowing against the fins. Upon visual observation, if the nock is properly aligned it will spin without any wobble. The precision of the manual spinning and visual observation methods of the nocks for wobbling has become insufficient, particularly for competition purposes. There is thus a need for a opto-mechanical device for assisting in checking the correct alignment of the nock for parallelism with the arrow shaft.

In the past, only one attempt has been made to obtain such an alignment check device. This device is in the form of an indicator having an alignment pin which is introduced in the nock groove. The accuracy of the checking operations carried out by means of this device is still insufficient compared to the accuracies obtained with the present manufacturing methods.

SUMMARY AND OBJECTS OF THE INVENTION

In view of the foregoing, it should be apparent that there exists a need in the art for an apparatus for aligning a nock on the rear end of an arrow shaft with a great degree of accuracy. It is, therefore, a primary object of the present invention to provide apparatus for obtaining such a degree of accuracy when aligning a nock on an arrow shaft which is characterized by a simple and sturdy structure.

More particularly, it is an object of this invention to provide an instrument which enables an accurate check of the straightness of the nock with the shaft of an archery arrow.

Still more particularly, it is an object of this invention to provide an alignment jig apparatus which is easy and reliable to operate and is portable for use in the field.

Briefly described, these and other objects of the invention are accomplished by an alignment jig with a rigid base plate having a first support for the rear portion of the arrow shaft, at which end the nock is mounted. At least one additional arrow shaft support is also provided, spaced apart from and longitudinally aligned with the first support. The arrow is thus mouned on the two supports with its axis extending in the longitudinal direction of the base plate.

A first reference line is arranged on the base plate. The first reference line is contained in a plane which extends through the supports and is perpendicular to the base plate; this first reference line being disposed at the opposite side of the first support relative the additional support or supports. A second reference line, which also extends in the same plane and is parallel to the first reference line, is disposed on the opposite side of an arrow supported by the supports relative to the first reference line. A sight device is provided for aligning the two reference lines between the nock shanks. This enables the checking of the proper longitudinal alignment of the nock with the end of the arrow with good accuracy.

With these and other objects, advantages and features of the invention that may become hereinafter apparent, the nature of the invention may be more clearly understood by reference to the following detailed description of he invention, the appended claims and to the several drawings attached herein.

DETAILED DESCRIPTION OF THE PREFERRED EMBODIMENT

Figure 1:
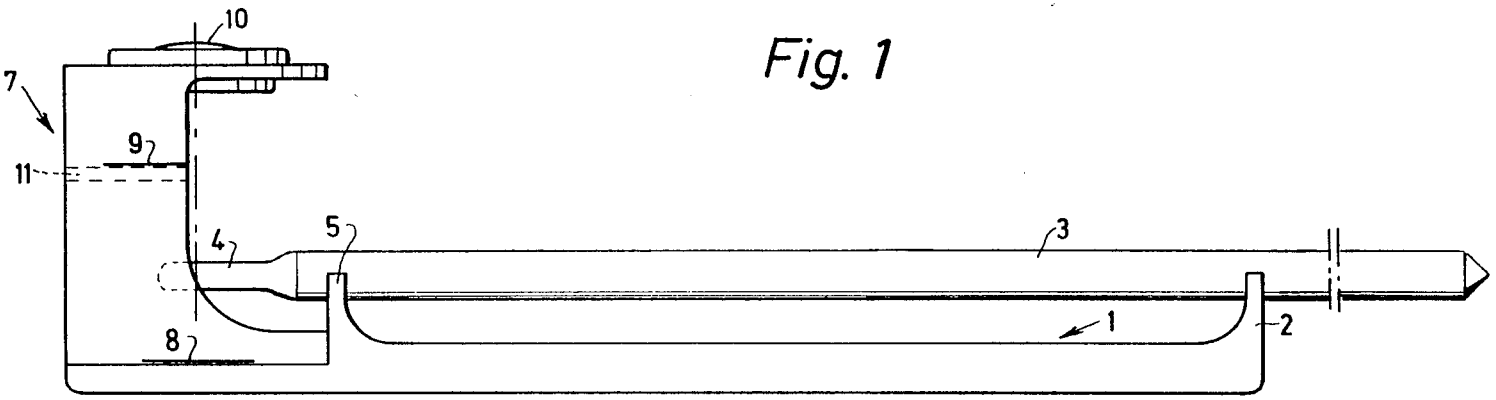
FIG. 1 is a side elevational view of the apparatus of the present invention.
Figure 2:
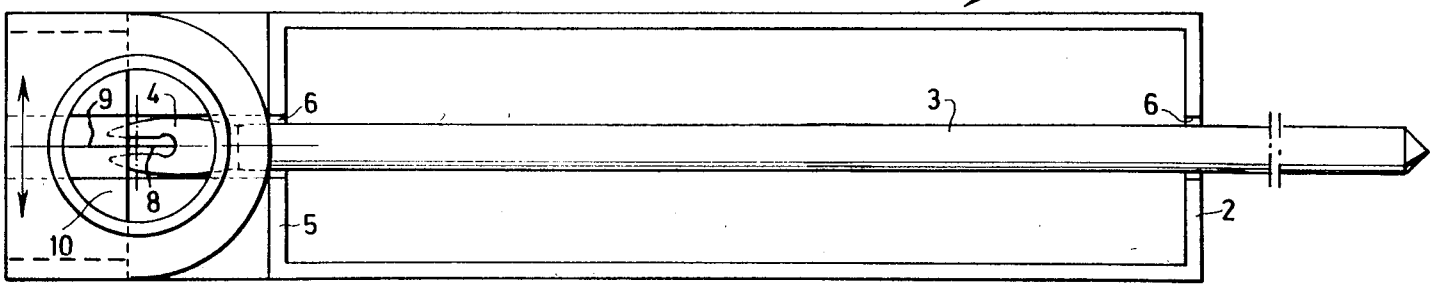
FIG. 2 is a top plan view of the apparatus of the present invention.

Referring now in detail to the drawings wherein like parts are designated by like reference numerals throughout, there is shown in FIG. 1 the alignment jig according to the present invention which comprises a rigid base plate 1 with a planar bottom surface for placement upon a suitable supporting surface such as a table top (not illustrated). The base plate 1 is made of construction plastic or the like, such as a glass fiber reinforced plastic material which is light-weight but strong and of sufficient constant dimensions during the conditions under which the jig will be used.

The base plate 1 has a first support 5 for the rear portion of the shaft of an arrow 3, at the end of which a nock 4 is to be mounted. The base plate 1 also has a further arrow support 2 which is spaced from and longitudinally aligned with said first support 5. In the embodiment illustrated in the drawings the supports 2 and 5 are made as transverse upright walls integrally formed with the base plate 1 and each provided with a V-shaped or otherwise similarly shaped notch 6 in which the arrow 3 can rest. In the embodiment illustrated, the support 5 is located at one end of the base plate 1, while the other support 2 is located a suitable distance away from the first support 5 as well as from the opposite end of the base plate 1. Beyond the further support 5, i.e., at the end of the base plate 1 opposite to the support 2, is mounted a sight device 7.

The sight device 7 includes a first reference line 8, arranged on the base plate and extending in a plane, said plane extending through the center of supports 2 and 5 and at a right angle to the base plate 1. The sight device 7 further includes a second reference line 9, which also extends in the same plane and is parallel to the first reference line 8. The second reference line 9 is suitably spaced vertically above the first reference line 8 in order to allow the introduction of the arrow nock 4 therebetween. The reference lines 8 and 9 may be made as indicia lines printed or otherwise applied to or engraved into the base plate 1 and the wall 11. Other forms of lines or indicia may also be used to accomplish the same purpose.

Although the pair of reference lines 8 and 9 allows a visual check of the straightness of the notch 4 with the shaft of the arrow 3, the accuracy is further enhanced when the sight device also includes a suitable optical aid, preferablyin the form of a magnifiying lens 10 or an ocular.

When using the alignment jig of the present invention, an arrow 3, onto the rear end taper of which a new nock 4 has just been applied using cement as initially described, is laid in the seats or notches 6 on the supports 2 and 5. Using his eye, the operator looks straight vertically down onto the nock 4. In an eye position in which the reference lines 8 and 9 are correctly aligned, the nock 4 is observed and if found correctly positioned, the shaft of the arrow 3 is rotated 90° by the operator's fingers and the nock 4 observed for any transversal misalignment. The sight device 7 has only a horizontal transverse wall 11 for supporting the second reference line 9 but has no end wall in order to allow the operator to introduce a finger below the wall to adjust the nock 4 if any misalignment is observed.

The alignment jig according to the present invention has been found to provide an easy but still extremely exact check of the correct alignment of the nock 4 on the arrow shaft end, especially in the field under the stress conditions encounterec in archery competitions.

Although the invention has been illustrated and described above in connection with a preferred embodiment, the invention is not limited thereto but can be modified as will be obvious to those skilled in the art. Thus, for example, the seats 6 for the arrow might well have another suitable profile other than a V, and the supports 2 and 5 might have other suitable locations than as illustrated. The invention will be limited only by the scope of the accompanying claims.

I claim:

1. Alignment apparatus for use in attaching a nock on an archery arrow, the nock having a groove defined by two shanks, comprising:

a rigid base plate;

first support means and at least one additional support means attached to said base plate for supporting the arrow;

said additional support means being spaced a distance apart from said first support means;

first reference means arranged on said base plate in a plane extending through all of said support means and perpendicular to said base plate;

second reference means extending parallel to the first reference means and disposed in the plane on the opposite side of an arrow supported by said support means relative to said first reference means; and sight means located adjacent to one of said support means and said first and second reference means, for aligning said pair of first and second reference means between the shanks of the nock of the arrow, whereby the proper longitudinal alignment of the nock with the end of the arrow can be checked with good accuracy.

2. The alignment apparatus of claim 1, wherein said first support means is provided for the rear of the arrow shaft and the at least one additional support means supports at least a portion of the arrow shaft forward of said arrow shaft rear.

3. The alignment apparatus of claim 1, wherein said first reference means is disposed on the opposite side of said first support means relative to said at least one additional support means.

4. The alignment apparatus of claim 1, wherein all said support means further include seats for the arrow shaft carried thereby.

5. The alignment apparatus of claim 1, wherein said first and second reference means comprise indicia lines applied to said alignment apparatus.

6. The alignment apparatus of claim 1, wherein said first and second reference means comprise indicia engraved onto said alignment apparatus.

7. The alignment apparatus of claim 1, further including a wall means extending upwardly from one end of said base plate and to which said sight means is afixed.

8. The alignment apparatus of claim 1, wherein said sight means is a magnifying lens or an ocular.

9. The alignment apparatus of claim 7, wherein said first reference means is situated in said base plate and said second reference means is situated on said wall means.

10. An alignment jig for use in attaching a nock on an archery arrow, the nock having a groove defined by two shanks, comprising:

a base including means for supporting the shaft of an arrow along an axis extending in the longitudinal direction of said base;

a plurality of reference means disposed in substantially vertically spaced parallel relationship with each other on said base in alignment with said axis; and sighting means disposed on said jig for aligning said reference means with the shanks of the nock so as to accurately align the nock on the arrow.

11. The alignment jig of claim 10, wherein said reference means comprise at least one reference line marked on said jig which can be seen through said sighting means.

12. The alignment jig of claim 10, wherein said reference means comprise a first reference line marked on said base and a second reference line marked on said jig above said base, said reference lines being contained in a plane common with said axis.

13. The alignment jig of claim 12, wherein said first reference line is disposed on one side of said axis and said second reference line is disposed on the other side of said axis, whereby when the nock of an arrow is accurately aligned said reference lines can be seen through said sighting means as being substantially equidistanct between the shanks of the nock.

14. The alignment jig of claim 10, wherein said sighting means is a magnifying lens or an ocular.

15. An alignment device, comprising:

a base;

support means mounted on the base for supporting a shaft in a fixed axis;

first reference means arranged on said base parallel with the axis; and second reference means arranged parallel to the first reference means;

said first and second reference means and the axis being on one plane substantially perpendicular to said base.

16. The alignment device according to claim 15, wherein the support means comprises a plurality of notched plates extending perpendicularly to the base.

17. The alignment device according to claim 16, further comprising a sighting means disposed on the base for aligning the reference means with the shaft.

18. The alignment device according to claim 16, further comprising a shelf mounted to the base in parallel spaced relationship therewith, said second reference means being located on the shelf.

19. The alignment device according to claim 18, wherein the first reference means comprises a line etched in the base.

* * * * *